US005175470A

United States Patent [19]

Garbowicz

[11] Patent Number: 5,175,470

[45] Date of Patent: Dec. 29, 1992

[54] FLUORESCENT LAMP ELECTRODE DISCONNECT ARRANGEMENT

[75] Inventor: Glenn D. Garbowicz, Rosemont, Ill.

[73] Assignee: North American Philips Corporation, New York, N.Y.

[21] Appl. No.: 629,868

[22] Filed: Dec. 19, 1990

[51] Int. Cl.[5] ..... H05B 41/36

[52] U.S. Cl. ..... 315/106; 315/97; 315/98; 315/101; 315/105; 315/DIG. 5

[58] Field of Search ..... 315/106, 101, 105, 107, 315/DIG. 5, 97, 98, 207

[56] References Cited

U.S. PATENT DOCUMENTS

| | | | |
|---|---|---|---|
| 4,010,399 | 3/1977 | Bessone et al. | 315/101 |
| 4,079,292 | 3/1978 | Kaneda | 315/105 X |
| 4,399,391 | 8/1983 | Hammer et al. | 315/105 X |
| 4,661,745 | 4/1987 | Citino et al. | 315/106 |
| 4,954,749 | 9/1990 | Crawford | 315/106 X |

*Primary Examiner*—Eugene R. LaRoche
*Assistant Examiner*—Do Hyun Yoo

[57] ABSTRACT

A fluorescent lamp system including a switch for each electrode of the lamp system wherein each switch is operable in response to the voltage across its associated lamp after its associated lamp turns on to interrupt the connection of an associated electrode to its associated heater winding.

20 Claims, 2 Drawing Sheets

FLUORESCENT LAMP ELECTRODE DISCONNECT ARRANGEMENT

BACKGROUND OF THE INVENTION

This is an invention in lighting. More particularly, it involves an arrangement for conserving power in the operation of fluorescent lamp systems.

It is desirable to decrease the power expended by fluorescent lamps by shutting off the current to the heater electrodes of such lamps after ignition. In the past a number of arrangements for doing this have been proposed. Some of these use relays (see U.S. Pat. No. 4,661,745 to Citino et al and U.S. Pat. No. 4,954,749 to Crawford). Relays can be noisy and are subject to wear. The use of a filament transformer has also been proposed (see U.S. Pat. No. 4,399,391 to Hammer et al). Arrangements with filament transformers require auxiliary protection against excessive currents which can be developed in case a lamp electrode is damaged and the lamp acts in the manner of a rectifier.

SUMMARY OF THE INVENTION

It is an object of this invention to provide an improved arrangement for discontinuing heater electrode current flow in fluorescent lamps after the lamps are ignited.

One of the features of the invention is that it responds to the decrease in voltage across the lamps of a two lamp rapid start fluorescent lamp system which takes place after lamp ignition.

One of the advantages of the invention is that it decouples all of the filaments of a rapid start fluorescent lamp system from the filament windings upon ignition of the fluorescent lamps of the system.

In accordance with one embodiment of the invention, there is provided a fluorescent lamp system comprising a fluorescent lamp having a pair of electrodes. A ballast is provided for connection to a proper source of voltage. The ballast when connected to a proper source of voltage provides voltage across the lamp. The ballast includes a pair of electrode windings. A pair of semiconductor switches is provided, each of which connects one of the electrode windings to a respective lamp electrode. Control means is connected across the lamp and responds to the voltage across the lamp when the lamp is on to render each of the semiconductor switches non-conductive. The control means responds to the voltage across the lamp when the lamp is off to render each of the semiconductor switches conductive.

In accordance with another aspect of the invention, there is provided a rapid start fluorescent lamp system comprising a plurality of fluorescent lamps each having a pair of electrodes. A ballast is provided for connection to a proper source of voltage. The ballast when connected to a proper source of voltage provides voltage across the lamps. The ballast includes a plurality of electrode windings for applying heating voltage to the electrodes of the fluorescent lamps. A plurality of switches are provided for connecting the electrode windings to the lamp electrodes. Control means is included which is connected across the lamps and is responsive to the voltage across the lamps when the lamps are on to render each switch non-conductive. The control means is also responsive to the voltage across the lamps when the lamps are off to render each switch conductive.

In accordance with a still further aspect of the invention there is provided a fluorescent lamp system comprising a fluorescent lamp having a pair of electrodes. A ballast is provided for connection to a proper source of voltage. The ballast when connected to a proper source of voltage provides voltage across the lamp. The ballast includes a pair of electrode windings. A pair of switches is provided, each connecting one of the electrode windings to a respective lamp electrode. Control means is connected across the lamp and responds to the voltage across the lamp when the lamp is off to conduct current which current renders each switch conductive.

BRIEF DESCRIPTION OF THE DRAWING

Other objects, features and advantage of the invention will be apparent from the following description and appended claims when considered in conjunction with the accompanying drawing in which:

DESCRIPTION OF THE PREFERRED EMBODIMENT

Figure 1:
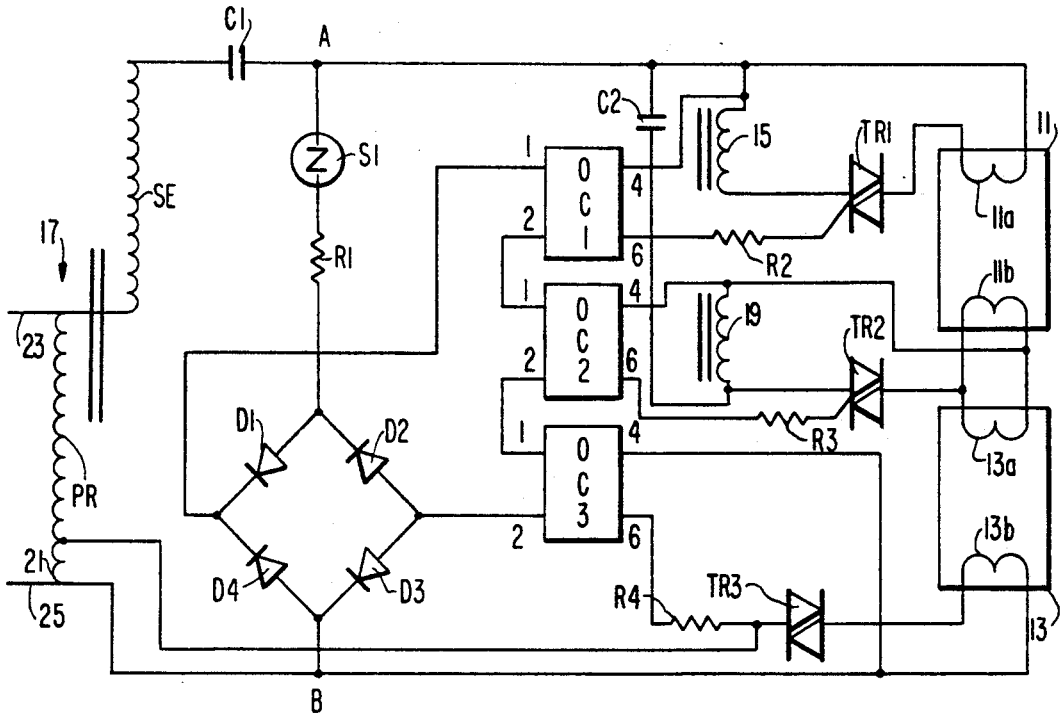
FIG. 1 is a schematic circuit diagram of one embodiment of the invention in a two-lamp rapid start fluorescent system.

Referring to FIG. 1, there is shown therein two fluorescent lamps 11 and 13 each having a pair of electrodes 11*a*, 11*b* and 13*a*, 13*b*, respectively. Electrode 11*a* is connected across heater winding 15 of autotransformer 17 through triac TR1. Electrodes 11*b* and 13*a* are connected through triac TR2 across heater winding 19 of transformer 17. Electrode 13*b* is connected through triac TR3 across winding 21 which forms part of primary winding PR of transformer 17. As is typical primary winding PR and secondary winding SE are connected through capacitor Cl across lamps 11 and 13 to provide operating voltage thereto. Such an operating voltage will be supplied when primary winding PR is connected to a proper source of voltage through lines 23 and 25.

Starting capacitor C2 is connected across lamp 11 in order for lamp 13 to start first and lamp 11 to follow in sequence thereafter. Also connected across lamps 11 and 13 from terminal A to terminal B is a circuit comprising sidac S1 resistor R1 and a diode bridge comprising diodes D1–D4. Connected in series across the diode bridge are the inputs 1 and 2 of optical couplers OC1, OC2 and OC3. As is well known a photodiode is connected across the input terminals 1 and 2 of optical couplers OC1, OC2 and OC3. As is also well known a light activated triac is connected across the output terminals 4 and 6 of each optical coupler OC1, OC2 and OC3. In this way optical couplers OC1, OC2 and OC3 provide electrical isolation between the diode bridge D1–D4 and the circuitry the light activated triacs are connected to. These light activated triacs of optical couplers OC1, OC2 and OC3 are connected through resistors R2, R3 and R4 to the gates of triacs TR1, TR2 and TR3, respectively, to render triacs TR1, TR2 and TR3 separately controlled. Signals for the gates of triacs TR1, TR2 and TR3 are generated by the voltages across the associated electrode windings 15, 19 and 21, respectively. The main conduction paths of triacs TR1, TR2 and TR3 are connected in series with heater windings 15, 19 and 21 and their respective lamp electrodes 11*a*, 11*b* and 13*a*, and 13*b*.

In operation when a proper voltage is applied across lines 23 and 25 to primary PR of autotransformer 17 a pre-ignition voltage is applied across junctions A and B sufficient for sidac S1 to breakover and permit conduction through itself, resistor R1 and the diode bridge formed by diodes D1–D4. As a result the photodiodes in optical couplers OC1, OC2 and OC3 connected in series across the diode bridge emit radiation and turn on the light activated triacs of optical couplers OC1, OC2 and OC3. This enables current to flow from heater windings 15, 19 and 21 through respective resistors R2, R3 and R4 to the gates of triacs TR1, TR2 and TR3. As a result, triacs TR1, TR2 and TR3 are rendered conductive and permit heater windings 15, 19 and 21 to provide heating current to electrodes 11*a*, 11*b*,13*a*, and 13*b* of lamps 11 and 13. Upon heating sufficiently electrode 13*a* and 13*b* will start conduction in lamp 13 to be followed shortly thereafter by conduction in lamp 11. Upon lamps 11 and 13 conducting the voltage across the lamps and across terminals A and B is no longer high enough to allow sidac S1 to conduct. As a consequence the light emitting diodes of optical couplers OC1, OC2 and OC3 no longer have voltage applied to them and can no longer emit light. As a consequence the light activated triacs of optical couplers OC1, OC2 and OC3 cease to conduct and no longer provide gating signals to the gates of triacs TR1, TR2 and TR3 which consequently cease conducting. As a result the electrodes of lamps 11 and 13 are no longer provided with current from heater windings 15, 19 and 21 with the consequent preservation of power which otherwise would be consumed.

In a tested embodiment using two 40 watt T12 lamps and with a power supply of 120 volts, 60 hertz applied across lines 23 and 25 autotransformer 17 produced a peak voltage across terminals A and B of 440 volts. Sidac S1 was selected with a 360 volts breakover voltage and consequently enabled conduction through resistor R1 and diodes D1–D4. Resistor R1 was selected to limit the current through the diode bridge to between 10 and 20 milliamps which met the specification for the photodiodes of optical couplers OC1, OC2 and OC3 which were made by Motorola & Harris Semi. Co. catalog number MOC3012. Triacs TR1, TR2 and TR3 for this constructed embodiment were made by Teccor Co. catalog number Q201E3. In this embodiment a total savings of about four (4) watts of power was experienced for both lamps.

Figure 2:
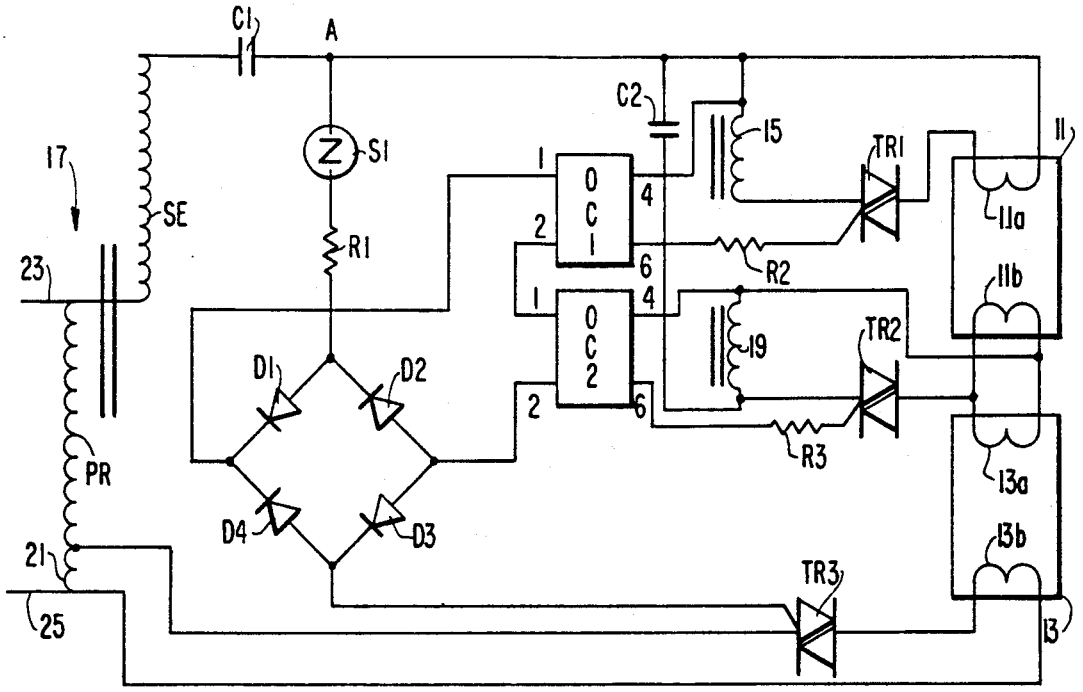
FIG. 2 is a schematic circuit diagram of a second embodiment of the invention in a two-lamp rapid start fluorescent system.

In the FIG. 2 embodiment, which was also tested, elements corresponding to those of the FIG. 1 embodiment are identified by the same reference characters. In this FIG. 2 embodiment it can be seen that the control means comprising sidac S1, resistor R1 and the diode bridge formed by diodes D1–D4 is not connected across terminals such as A and B of FIG. 1 but directly to the gate of triac TR3 and through electrode 13*b* of lamp 13 to line 25. With this arrangement an optical coupler such as OC3 of the FIG. 1 embodiment is no longer required. For purposes of operation however triac TR3 was changed from one made by Teccor Co. catalog part number Q201E3 to one made by Teccor Co. catalog part number L201E3. Other components of the FIG. 2 embodiment were the same as the corresponding components of the FIG. 1 embodiment. In this FIG. 2 embodiment the control means comprising the circuitry containing sidac S1 and the optical couplers OC1, OC2 enabled triacs TR1, TR2 and TR3 to provide heating power to the electrodes of lamps 11 and 13 to enable them to ignite and upon ignition the control means responded to the reduction in the voltage across the lamps to render triacs TR1, TR2 and TR3 non-conductive.

Figure 3:
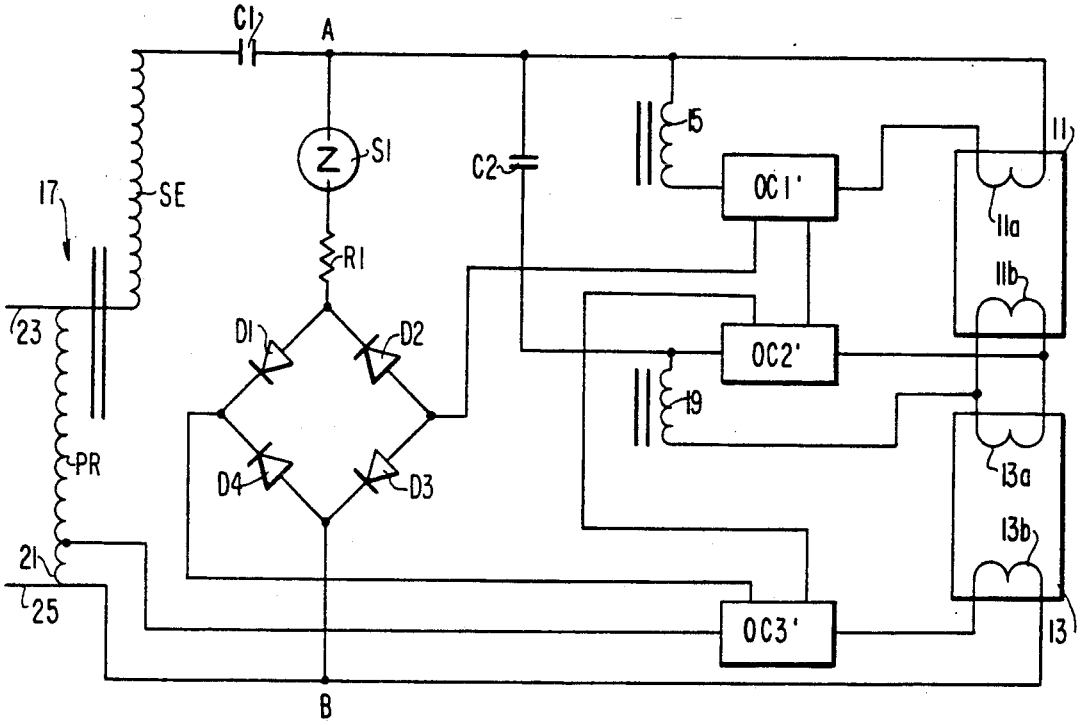
FIG. 3 is a schematic circuit diagram of a third embodiment of the invention in a two-lamp rapid start fluorescent system.

In the FIG. 3 embodiment the optical couplers have been identified by the reference characters OC1', OC2' and OC3' to distinguish them from the optical couplers of the other two embodiments. The reason for this is that these optical couplers were Toshiba catalog part number TLP3520 type which combines the function of an optical coupler with an output triac in a single integrated circuit package. Consequently, separate triacs such as TR1, TR2 and TR3 of the other two embodiments disclosed herein and the resistors associated therewith are not necessary in the FIG. 3 embodiment. Otherwise the operation of the FIG. 3 embodiment is the same as that of the FIG. 1 and FIG. 2 embodiments.

As those skilled in the art will appreciate, while only one type of ballast arrangement has been specifically disclosed herein the invention described will operate with various other ballast arrangements.

It should be apparent that modifications of the above will be evident to those skilled in the art and that the arrangements described herein are for illustrative purposes and are not to be considered restrictive.

What is claimed is:

1. A fluorescent lamp system comprising a fluorescent lamp having a pair of electrodes, a ballast for connection to a proper source of voltage, said ballast when connected to the proper source of voltage providing voltage across said lamp, said ballast including a pair of electrode windings, a pair of semiconductor switches, each connecting one of said electrode windings to a respective lamp electrode, and control means connected across said lamp and responsive to said voltage across said lamp when said lamp is on to render each said semiconductor switch non-conductive, said control means being responsive to said voltage across said lamp when said lamp is off to render each said semiconductor switch conductive.

2. A fluorescent lamp system according to claim 1, wherein said control means includes a semiconductor conducting device connected in parallel with said lamp and wherein current through said semiconductor conducting device renders said pair of semiconductor switches conductive.

3. A fluorescent lamp system according to claim 2, wherein an optical coupler electrically isolates at least one of said pair of semiconductor switches from the current through said semiconductor conducting device, control signals for the control electrode of said at least one semiconductor switch being generated from the electrode winding to which said at least one semiconductor switch is connected.

4. A fluorescent lamp system according to claim 3, wherein the second of said pair of semiconductor switches directly receives the current through said semiconductor conducting device.

5. A rapid start fluorescent lamp system comprising, a plurality of fluorescent lamps each having a pair of electrodes, a ballast for connection to a proper source of voltage, said ballast when connected to the proper source of voltage providing voltage across said lamps, said ballast including a plurality of electrode windings connected to said electrodes, a plurality of switches, one for each electrode winding, each connected between its associated electrode winding and an associated electrode, and control means connected across said lamps and responsive to said voltage across said lamps when said lamps are on to render each said switch non-conductive, said control means being operable in response to said voltage across said lamps when said lamps are off to render each said switch conductive, voltage for operating at least one of said switches between its non-conducting state and its conducting state being supplied by the electrode winding to which said at least one switch is connected.

6. A rapid start fluorescent lamp system according to claim 5, wherein said control means includes a semiconductor conducting device connected in parallel with said lamps and wherein current through said semiconductor conducting device renders said plurality of switches conductive.

7. A rapid start fluorescent lamp system according to claim 6, wherein an optical coupler electrically isolates at least one of said plurality of switches from the current through said semiconductor conducting device.

8. A fluorescent lamp system according to claim 7, wherein at least one of said plurality of switches directly receives the current through said semiconductor conducting device.

9. A fluorescent lamp system comprising a fluorescent lamp having a pair of electrodes, a ballast for connection to a proper source of voltage, said ballast when connected to the proper source of voltage providing voltage across said lamp, said ballast including a pair of electrode windings, a pair of semiconductor switches, each connecting one of said electrode windings to a respective lamp electrode, and control means connected across said lamp and responsive to said voltage across said lamp when said lamp is off to conduct current, said current rendering each said semiconductor switch conductive, said control means being responsive to said voltage across said lamp when said lamp is on to render each said semiconductor switch non-conductive.

10. A fluorescent lamp system according to claim 9, wherein said control means includes a semiconductor conducting device connected in parallel with said lamp.

11. A fluorescent lamp system according to claim 10, wherein an optical coupler electrically isolates at least one of said pair of semiconductor switches from the current through said semiconductor conducting device, control signals for the control electrode of said at least one semiconductor switch being generated from the electrode winding to which said at least one semiconductor switch is connected.

12. A fluorescent lamp system according to claim 11, wherein the second of said pair of semiconductor switches directly receives the current through said semiconductor conducting device.

13. A rapid start fluorescent lamp system comprising, a plurality of fluorescent lamps each having a pair of electrodes, a ballast for connection to a proper source of voltage, said ballast when connected to the proper source of voltage providing voltage across said lamps, said ballast including a plurality of electrode windings connected to said electrodes, a plurality of switches, one for each electrode winding, each connected between its associated electrode winding and an associated electrode, and control means connected across said lamps and responsive to said voltage across said lamps when said lamps are off to conduct current, said current rendering each said switch conductive, said control means being operable in response to said voltage across said lamps when said lamps are on to render each said switch non-conductive.

14. A rapid start fluorescent lamp system according to claim 13, wherein said control means includes a semiconductor conducting device connected in parallel with said lamps.

15. A rapid start fluorescent lamp system according to claim 14, wherein an optical coupler electrically isolates at least one of said plurality of switches from the current through said semiconductor conductive device.

16. A rapid start fluorescent lamp system according to claim 15, wherein at least one of said plurality of switches directly receives the current through said semiconductor conducting device.

17. A rapid start fluorescent lamp system comprising, a plurality of fluorescent lamps each having a pair of electrodes, a ballast for connection to a proper source of voltage, said ballast when connected to the proper source of voltage providing voltage across said lamps, said ballast including a plurality of electrode windings connected to said electrodes, a semiconductor switch for each electrode winding connected between its associated electrode winding and an associated electrode, and control means connected across said lamps and responsive to said voltage across said lamps when said lamps are on to render each said semiconductor switch non-conductive, said control means being operable in response to said voltage across said lamps when said lamps are off to render each said switch conductive.

18. A rapid start fluorescent lamp system according to claim 17, wherein said control means includes a semiconductor conducting device connected in parallel with said lamps and wherein current through said semiconductor conducting device renders said semiconductor switches conductive.

19. A rapid start fluorescent lamp system according to claim 18, wherein an optical coupler electrically isolates at least one of said semiconductor switches from the current through said semiconductor conducting device, control signals for the control electrode of said at least one semiconductor switch being generated from the electrode winding to which said at least one semiconductor switch is connected.

20. A rapid start fluorescent lamp system according to claim 19, wherein at least one of said semiconductor switches directly receives the current through said semiconductor conducting device.

* * * * *